US007793626B2

(12) United States Patent
Bugescu et al.

(10) Patent No.: US 7,793,626 B2
(45) **Date of Patent: *Sep. 14, 2010**

(54) HYDRAULIC CAM FOLLOWER

(75) Inventors: Florin Bugescu, Canton, MI (US); Jemel Jones, Southfield, MI (US); Richard Best, Grem, UT (US)

(73) Assignee: Schaeffler KG, Herzogenaurach (DE)

( * ) Notice: Subject to any disclaimer, the term of this patent is extended or adjusted under 35 U.S.C. 154(b) by 397 days.

This patent is subject to a terminal disclaimer.

(21) Appl. No.: 11/946,115

(22) Filed: Nov. 28, 2007

(65) Prior Publication Data

US 2008/0149054 A1 Jun. 26, 2008

Related U.S. Application Data

(60) Provisional application No. 60/867,404, filed on Nov. 28, 2006.

(51) Int. Cl.
*F01L 1/34* (2006.01)

(52) U.S. Cl. ..... 123/90.16; 123/90.52; 123/90.55

(58) Field of Classification Search ..... 123/90.57, 123/90.52, 90.55, 90.48, 90.16, 90.5
See application file for complete search history.

(56) References Cited

U.S. PATENT DOCUMENTS

2001/0004886 A1* 6/2001 Brothers ..... 123/90.48

FOREIGN PATENT DOCUMENTS

DE 102004019282 12/2005

* cited by examiner

*Primary Examiner*—Zelalem Eshete
(74) *Attorney, Agent, or Firm*—Volpe and Koenig, P.C.

(57) ABSTRACT

A hydraulic cam follower (1), such as a roller tappet, is provided. This is used for the actuation of two identically operating gas-exchange valves and should be installed inclined to the direction of the force of gravity. The cam follower (1) comprises a pot-shaped housing (2), whose bottom (3) is provided with a roller as a cam contacting element (4). In the housing (2), two guides (5) extending parallel to the direction of the internal combustion engine are provided, in each of which a pressure piston (6) is arranged so that it can move axially, whose end (7) away from the housing is constructed as a support for contact with a respective tappet pushrod. Each pressure piston (6) encloses a reservoir (11) for hydraulic medium. For each pressure piston (6), an opening (13) extends from the outer casing (12) of the housing (2) for feeding hydraulic medium to the reservoirs (11), wherein the openings (13) are arranged on a peripheral segment of the outer casing (12) lying at the top viewed in the direction of the force of gravity. Thus, a so-called double roller tappet is provided as a cam follower (1), which can store a sufficiently large amount of hydraulic medium despite its inclined installation.

15 Claims, 1 Drawing Sheet

HYDRAULIC CAM FOLLOWER

CROSS-REFERENCE TO RELATED APPLICATIONS

This application claims the benefit of U.S. Provisional Application 60/867,404, filed Nov. 28, 2006, which is incorporated by reference herein as if fully set forth.

BACKGROUND

The invention relates to a hydraulic cam follower, especially for a tappet pushrod valve train of an internal combustion engine, which is provided for installation at an angle to the direction of the force of gravity, with a pot-shaped housing, whose bottom is provided with at least one cam contacting element, wherein in the housing there are two guides, in each of which a pressure piston is arranged so that it can move in the axial direction, wherein each end of the pistons is provided as an installation for contact with a respective tappet pushrod.

Such cam followers for the simultaneous actuation of several identically operating gas-exchange valves (preferably two, but not a requirement) do not have to be explained in more detail at this point. Their installation at an angle to the direction of the force of gravity comes into question, in particular, when they are used in V-type engines with a camshaft being located underneath.

In general, the goal of greater reduction in the oscillating valve train masses leads to the increase in the miniaturization of such cam followers. In this way, the amount of hydraulic medium that can accumulate in the reservoir of the pressure piston of the cam follower necessarily decreases. In other words, the ratio of reservoir volume to high-pressure space volume becomes less favorable. If such cam followers are installed, as above, at an angle to the direction of the force of gravity, then under unfavorable circumstances, the otherwise only small amount of hydraulic medium in the reservoir can run out successively after the internal combustion engine is stopped or, in general, this amount of hydraulic medium can be insufficient for non-knocking engine operation, especially when the internal combustion engine is started up again (after a long time standing still). Exactly those pressure pistons standing at the valve lift when the internal combustion engine is stopped are here at the most danger.

In the state of the art (see DE 10 2004 019 282 A1), for tappet pushrod valve trains with so-called "top-down oiling" it was attempted to use the tappet pushrod as a reservoir for hydraulic medium. Such a measure is rather complicated in terms of construction effort and cannot be applied to a plurality of valve trains with oil supply systems that deviate from the above.

SUMMARY

Therefore, the object of the invention is to create a cam follower of the type noted above, in which despite an inclined installation and miniaturized reservoirs, there is a sufficiently large amount of hydraulic medium for problem-free operation.

This objective is met according to the invention. Accordingly, on the outer casing of the housing of the cam follower there is at least one opening for feeding hydraulic medium to the reservoirs, which extends on a peripheral segment of the outer casing lying at the top viewed in the direction of the force of gravity.

Thus, after the internal combustion engine is stopped, the hydraulic medium can fall only to the level of the opening "lying at the top" in the cam follower. Simultaneously, the hydraulic medium path between the opening and the actual reservoir is also used as an additional hydraulic medium reservoir.

Indeed, the invention relates, in particular, to cam followers for tappet pushrod valve trains, but the measures according to the invention are also conceivable and provided for additional double-action valve train elements of a hydraulic construction. If necessary, the cam follower can also act directly on two rocker arms, without the tappet pushrod, via its pressure piston.

A solution is also conceivable and provided, in which more than two pressure pistons are installed in the pot-like housing of the cam follower, for example, three pressure pistons do not have to lie in a row one next to the other and thus can be used for actuating three identically operating gas-exchange valves.

According to an especially preferred refinement of the invention, each pressure piston should be provided with hydraulic medium from its own opening in the housing. These openings are arranged in the provided inclined installation of the cam follower, so that they lie on a peripheral segment of the outer casing of the housing located at the top viewed in the direction of the force of gravity.

Because the crossbar with the guides should preferably run parallel to the camshaft direction, preferably the openings are not positioned at the highest geodetic position on the outer casing of the housing, but instead in a cut-out region of the crossbar with the housing. Thus, the channels following the openings extend towards each other like legs.

In one embodiment of the invention, a hollow space formed between an inner casing of the housing and sides of the crossbar are used selectively as an additional reservoir for hydraulic medium, wherein this hollow space is then preferably closed in the tappet pushrod direction.

The crossbar noted above can be formed integrally with the housing. Its separate construction, however, is also conceivable and provided for.

In a refinement of the invention, it is proposed to provide a transmission of the hydraulic medium, starting from the channels following the openings, via known annular groove-borehole measures.

As assembly aids and for protection against rotating, it is possible to provide the outer casing of the housing with least one radially projecting element like a needle or the like. If necessary, partial peripheral regions of the housing can also be flattened, so that here simple protection against rotating for the cam follower is also created.

As a cam contacting surface, it is provided according to another embodiment of the invention to apply a roller to the housing. If necessary, a sliding surface also can be utilized. In the case of the construction of the cam follower for a switchable valve lift, several rollers arranged one next to the other on an axle can also be provided as cam contacting element in a way that is familiar to someone skilled in the art.

If the cam follower, as noted above, is to have a construction that can be deactivated or activated, then in its inner coupling means, such as pistons in a known construction can be applied, which then can be displaced hydraulically in at least one force-applying direction.

A measure in the direction of reducing costs is then provided when serial or series-like support elements are reverted to for the guides with pressure pistons.

If the openings are arranged high (relative to a height of the housing), as further stated according to the invention, so that they "still just" intersect the corresponding crossbar, then an especially large hydraulic medium quantity can be stored in the inclined installation.

In addition, it is possible to provide a cylindrical construction to the housing. Optionally, shapes deviating from this, such as elliptical or the like, are also conceivable and provided.

BRIEF DESCRIPTION OF THE DRAWING

The invention is preferably explained in more detail with reference to the drawing.

Shown are.

DETAILED DESCRIPTION OF THE PREFERRED EMBODIMENTS

Figure 1:
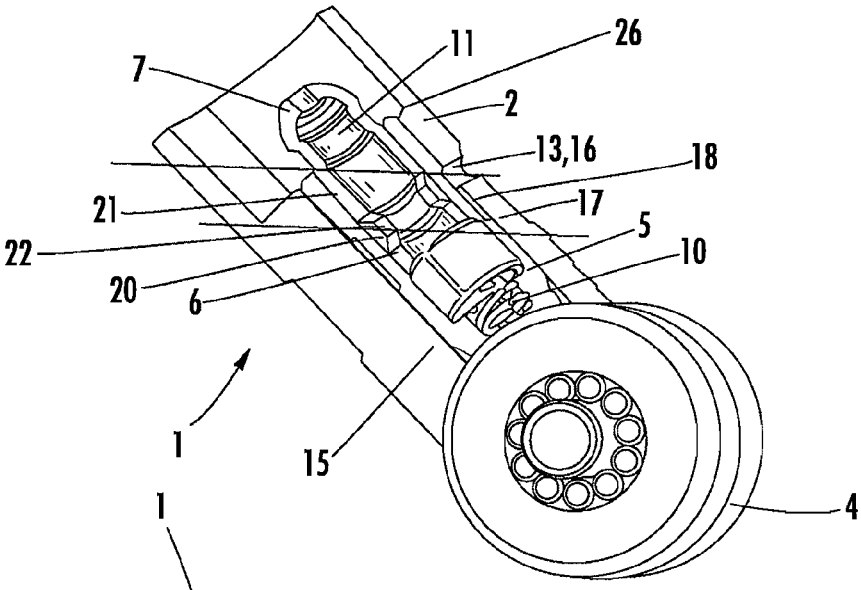
FIG. 1 a partial longitudinal section view through an inclined cam follower, FIG. 2 a longitudinal section view through the cam follower in the region of the transverse center plane of the longitudinal crossbar, and FIG. 3 a cross sectional view through the cam follower at the height of the openings in the housing.
Figure 2:
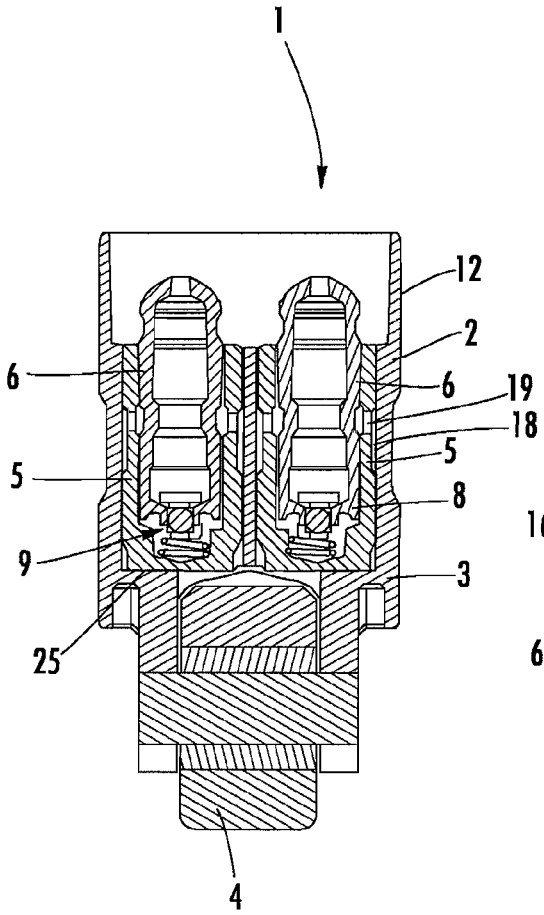

Shown is a hydraulic cam follower 1, here a roller tappet, which is provided for an inclined installation in a tappet pushrod valve train of an internal combustion engine. The cam follower 1 is constructed as a so-called "double roller tappet" and is used for simultaneously acting on two identical-action gas-exchange valves.

The cam follower 1 are comprised of a pot-like housing 2, whose bottom 3 is provided with a roller as cam contacting element 4. The housing 3 is split, in a similar manner to glasses, by a crossbar 15. When the cam follower 1 is installed, the crossbar 15 should extend parallel to the camshaft direction. In the crossbar 15 there are two guides 5 lying one next to the other, in each of which an axially moving pressure piston 6 is held with its outer casing 21.

Each pressure piston 6 projects with its end 7 past a top side 26 of the crossbar 15. On its area facing the bottom 3 of the housing 2 it has a base 8 with a non-return valve 9. Underneath the base 8 there is a high-pressure space 10, into which the non-return valve 9 opens. Above each of the bases 8, in a direction toward the end 7, each pressure piston 6 encloses a reservoir 11 for hydraulic medium. Also to be seen is that an anti-rotating device 24 is applied to the outer casing 12 of the housing 2. These can comprise, for example, a simple roller needle or a similar element. Optionally, the anti-rotating device 24 can also be constructed as a recess in the outer casing 12 of the housing 2.

Figure 3:
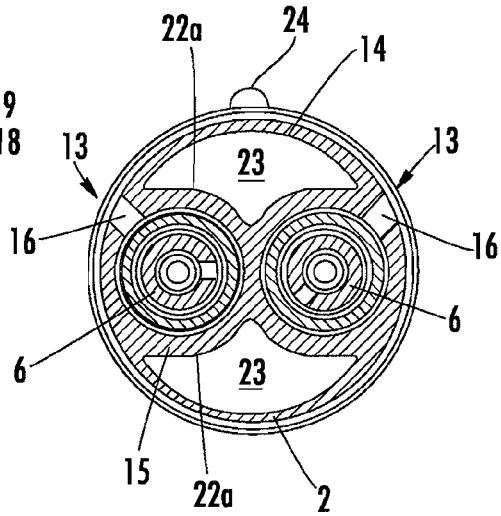

FIG. 1 discloses the cam follower 1 in an inclined position, like for its inclined installation (in a V-engine). Here, for each pressure piston 6, on a peripheral segment of the outer casing 12 of the housing 2 lying high in the direction of the force of gravity there is an opening 13 for feeding hydraulic medium. From each opening 13, a channel 16 for the hydraulic medium goes through the crossbar 15 to an outer casing 17 of the corresponding guide 5. Here it is to be seen that the channels 16, starting from their high geodetic opening 13, extend toward each other like legs. It is conceivable to lead one or more channels to the corresponding pressure pistons 6 starting from the highest geodetic opening (FIG. 3, the area of the anti-rotating device 24).

From the outer casing 17, the hydraulic medium is transmitted radially inward via an annular groove 18 to the outer casing 17 in at least one opening 19 (borehole). From this opening 19, the hydraulic medium can be led to an annular groove 20 at the outer casing 21 of the pressure piston 6, which annular groove 20 is provided with at least one passage 22 (borehole) to the reservoir 11.

Due to the high openings 13 viewed in the direction of the force of gravity for feeding the hydraulic medium from a corresponding guide, which is connected or can be connected to the internal combustion engine, the hydraulic medium in the interior of the cam follower 1 can fall only to a level that is documented by the horizontal line shown at the top in FIG. 1. In another structural "higher arrangement" of the openings 13 (see FIG. 1) on the outer casing 12 of the housing 2, it would be possible to accumulate an even greater quantity of hydraulic medium in the interior of the cam follower 1. The highest possible arrangement is here given by a top side 26 of the crossbar 15. All of the hydraulic medium paths positioned after the openings 13 are thus used as additional hydraulic medium reservoirs, so that despite the inclined installation of the cam follower 1, a sufficiently large hydraulic medium quantity for a proper play equalization of the internal combustion engine is always given, especially, but not exclusively, after its restart.

LIST OF REFERENCE SYMBOLS

1) Cam follower
2) Housing
3) Bottom
4) Cam contacting element
5) Guide
6) Pressure piston
7) End
8) Base
9) Non-return valve
10) High-pressure space
11) Reservoir
12) Outer casing
13) Opening
14) Inner casing
15) Crossbar
16) Channel
17) Outer casing
18) Annular groove
19) Opening
20) Annular groove
21) Outer casing
22) Passage
22*a*) Side
23) Hollow space
24) Anti-rotating device
25) Bottom
26) Top side

The invention claimed is:

1. A hydraulic cam follower for a pushrod valve train of an internal combustion engine, said cam follower being adapted to actuate two identically operating gas exchange valves and being installable in a position inclined to a direction of gravitational force, said cam follower comprising a pot-shaped housing having a bottom equipped with at least one cam contacting element, two guides being arranged in the housing, and a respective pressure piston is arranged in each of the guides for axial displacement, a housing-distal end of each of the pressure pistons serving as a support for a contact with a respective pushrod and a housing proximate base of each of the pressure pistons including a one-way valve, a respective high pressure chamber being formed under each of the bases and a respective reservoir for hydraulic medium being formed in a direction of the respective ends above each of the respective bases, an outer peripheral surface of the housing including at least one opening for supplying hydraulic medium to the reservoirs, and, as viewed in a direction of the gravitational force, said at least one opening extending in an upper peripheral segment of the outer peripheral surface.

2. The cam follower of claim 1, wherein the guides for the pressure pistons extend at least approximately parallel to an internal combustion engine direction in a crossbar connected at least at both ends to an inner peripheral surface of the housing, the at least one opening comprising at least one separate opening in the outer peripheral surface of the housing for each of the pressure pistons, a channel for the hydraulic medium extends from each of the openings through the crossbar to an outer peripheral surface of each of the respective guides, the channels are so arranged, starting from the openings, which are located at a high geodetic position, so that they extend toward each other toward an imaginary crossing point at a geodetically deeper lying position.

3. The cam follower according to claim 2, wherein the hydraulic medium is transmitted, starting from the outer casing of each of the guides, radially inward via an annular groove on an outer casing of each of the guides, which communicates with at least one opening in the annular groove, and from the openings, to an annular groove on an outer casing of the pressure piston and also from at least one passage into the reservoir.

4. The cam follower according to claim 2, wherein the crossbar separates the housing across a medial portion thereof, and sides of the crossbar, which is constructed like a chord and also equidistant to a longitudinal center plane of the crossbar define cylinder segment-like hollow spaces in the housing.

5. The cam follower according to claim 4, wherein the hollow spaces in the housing have an open or closed construction in an end direction and for a closed construction provide an additional reservoir for the hydraulic medium.

6. The cam follower according to claim 1, wherein a crossbar is connected either integrally or in multiple parts to the housing.

7. The cam follower according to claim 1, wherein the housing is provided with an anti-rotating device comprising at least one element projecting in some sections radially from the housing or a flattened section.

8. The cam follower according to claim 1, wherein the pressure pistons can rotate freely in the respective guides and the guides are fixed in position.

9. The cam follower according to claim 1, wherein the cam follower has a non-switchable or switchable construction.

10. The cam follower according to claim 1, wherein at least one cylinder-supported or slide-supported roller is provided as the cam contacting element.

11. The cam follower according to claim 1, wherein the guides are constructed as separate sleeves, having bottoms that stand at least indirectly on the base of the housing and define the high-pressure space on a housing side.

12. The cam follower according to claim 1, wherein for the pressure pistons, the bases and non-return valves, components of a serial assembled support element are provided.

13. The cam follower according to claim 12, wherein a housing of each of the serial support elements is also used as a guide for each pressure piston.

14. The cam follower according to claim 2, wherein the openings open at a housing height radially inward to the crossbar, which lies directly adjacent to a top side of the crossbar.

15. The cam follower according to claim 1, wherein the housing has a cylindrical construction.

* * * * *